United States Patent [19]

Neudorfer

[11] Patent Number: 4,628,706

[45] Date of Patent: Dec. 16, 1986

[54] PROCESS OF DEFROSTING AN EVAPORATOR OF A REFRIGERATION SYSTEM

[75] Inventor: Johann Neudorfer, Regau, Austria

[73] Assignee: Neura Elektronics Technische Anlagen Gesellschaft mbH, Vocklabruck, Austria

[21] Appl. No.: 769,866

[22] Filed: Aug. 27, 1985

[30] Foreign Application Priority Data

Sep. 4, 1984 [AT] Austria ..... 2823/84

[51] Int. Cl.[4] ..... F25B 47/00

[52] U.S. Cl. ..... 62/278; 62/196.4; 62/238.7; 62/324.5; 62/430

[58] Field of Search ..... 62/160, 196.4, 324.5, 62/324.6, 151, 278, 81, 430, 238.6, 238.7

[56] References Cited

U.S. PATENT DOCUMENTS

| | | | |
|---|---|---|---|
| 2,641,908 | 6/1953 | Porte | 62/115 |
| 2,718,764 | 9/1955 | Kramer | 62/278 X |
| 3,838,582 | 10/1974 | Redfern et al. | 62/196 |
| 4,139,356 | 2/1979 | Hattori | 62/278 |
| 4,176,526 | 12/1979 | Missimer | 62/278 |
| 4,279,129 | 7/1981 | Cann et al. | 62/278 |
| 4,343,157 | 8/1982 | Hattori | 62/278 X |

FOREIGN PATENT DOCUMENTS 133462 1/1979 German Democratic Rep. .

*Primary Examiner*—Lloyd L. King

*Attorney, Agent, or Firm*—Kurt Kelman

[57] ABSTRACT

In a process of defrosting an evaporator of a refrigeration system used for refrigeration or as a heat pump, the refrigerant circuit leading from the compressor to the condenser and from the latter through a throttle valve and the evaporator back to the compressor is altered and the refrigerant delivered by the compressor is supplied to the evaporator and caused to by-pass the condenser. The refrigerant is used as a heat source for a heat accumulator during normal operation and the heat accumulator is used as a heat source for the refrigerant during a defrosting operation. In order to permit the efficiency of the defrosting operation to be improved with a low expenditure, surplus heat of the condensed refrigerant leaving the condenser is supplied to the heat accumulator and defrosting is effected in that heat accumulated in the heat accumulator is used to evaporate the refrigerant when it has been condensed by a delivery of heat from the refrigerant to the evaporator and has been pressure-relieved by the throttle valve.

5 Claims, 1 Drawing Figure

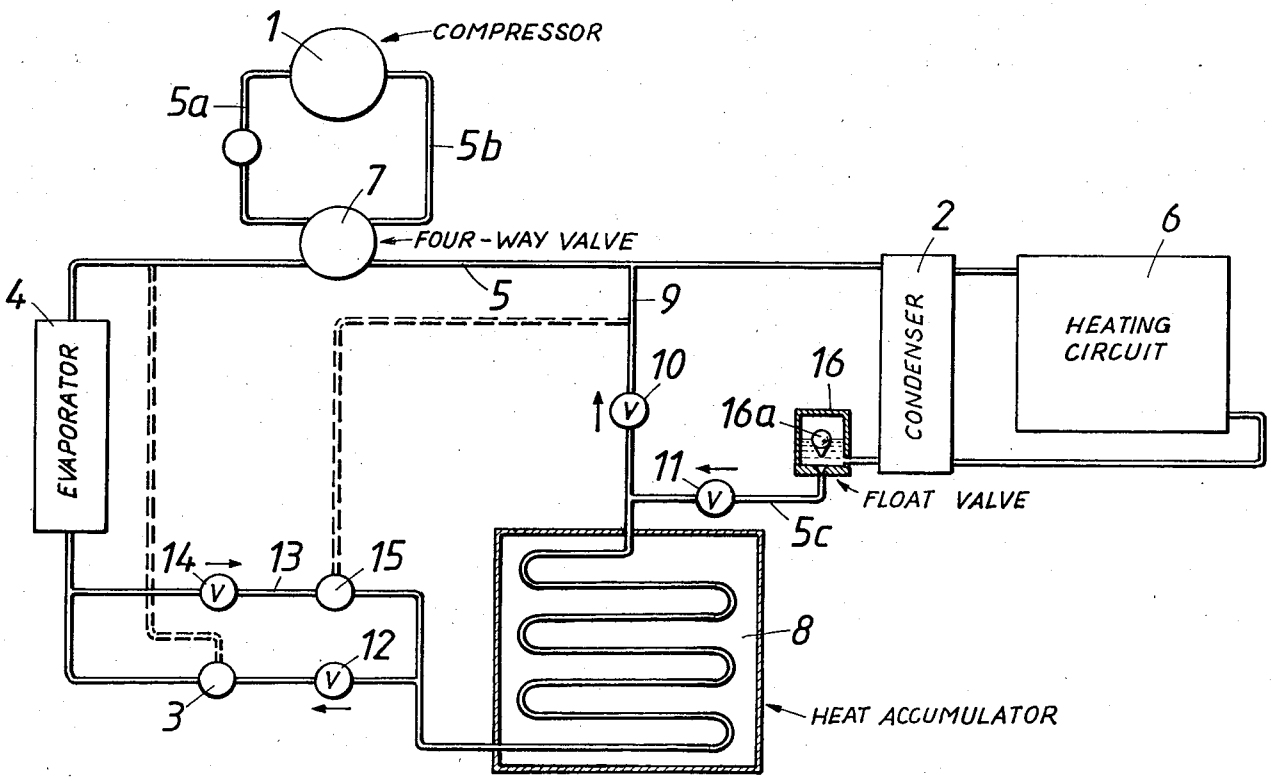
HEATING CIRCUIT
6
CONDENSER
2
FLOAT VALVE
16
16a
5c
HEAT ACCUMULATOR
8
11
10
9
FOUR-WAY VALVE
5
COMPRESSOR
5b
7
1
5a
15
12
13
14
3
EVAPORATOR
4

PROCESS OF DEFROSTING AN EVAPORATOR OF A REFRIGERATION SYSTEM

BACKGROUND OF THE INVENTION

1. Field of the Invention

This invention relates to a process of defrosting an evaporator of a refrigeration system used for refrigeration or as a heat pump, wherein the refrigerant circuit leading from the compressor to the condenser and from the latter through a throttle valve and the evaporator back to the compressor is altered and the refrigerant delivered by the compressor is supplied to the evaporator and caused to by-pass the condenser, the refrigerant is used as a heat source for a heat accumulator during normal operation and the heat accumulator is used as a heat source for the refrigerant during a defrosting operation. The invention relates also to a refrigerating system for carrying out that process.

2. Description of the Prior Art

For an operation of heat pumps using air as a source of energy, the evaporator must not be covered with ice, which would restrict the transfer of heat from the air to the refrigerant. For this reason the evaporator or evaporators must be defrosted from time to time when there is a danger of icing. This may be accomplished by expensive heating means supplied with extraneous energy and consisting particularly of electric resistance heaters, and it is also known for that purpose to reverse the heat pump cycle and to permit hot refrigerant vapor to flow directly into the evaporator. In that case the evaporator operates virtually as a condenser and the heat released by the condensation of the refrigerant vapor is used to defrost the evaporator. The thus condensed refrigerant is pressure-relieved in the throttle valve and then flows in the reversed direction of flow through the condenser proper of the heat pump; that condenser is now operated as an evaporator, and finally back to the compressor. The latter is operatively connected by means of a heat exchanger to a heating circuit and during the defrosting operation extracts from that heating circuit the heat required to evaporate said refrigerant. As a result, the heating system is cooled, which is most undesirable from the aspect of a conservation of energy, and the operation of the refrigerating system is rendered rather uneconomical.

In U.S. Pat. Nos. 3,838,582 and 2,641,908 it has already been proposed to supply heat from the refrigerant to a heat accumulator and to use the thus accumulated heat for defrosting. In those cases the heat accumulator closely succeeds the compressor so that defrosting is effected by superheat energy. That practice is also uneconomical and adds to the structural expenditure of the system owing to the high temperatures and pressures which are required.

East German Patent Specification No. 133,462 discloses a heat pump having a plurality of evaporators and adapted to defrost the evaporators by means of the residual heat content of the condensate leaving the condenser. For this purpose a part of that condensate, which is still warm, is passed through the evaporators in alternation in order to defrost the latter. In that case, the structural expenditure is relatively high and each evaporator cannot be completely defrosted unless the condensate has a relatively high temperature of about 50° C. For this reason such heat pump cannot be used for low-temperature heating systems, such as floor heating systems, although heat pumps are particularly useful for that purpose in other respects.

SUMMARY OF THE INVENTION

It is an object of the invention to eliminate the disadvantages mentioned above and to provide a process which is of the kind described first hereinbefore and which permits an economical defrosting of an evaporator of a heat pump and involves only a low structural expenditure.

Another object is to provide a simple refrigerating system for carrying out such process.

The object set forth is accomplished in accordance with the invention in that surplus heat of the condensed refrigerant leaving the condenser is supplied to the heat accumulator and defrosting is effected by the heat accumulated in the heat accumulator while the refrigerant condensed by heat transfer in the evaporator and depressurized by the throttle valve is evaporated. Because surplus heat of the condensate is accumulated during normal operation the evaporator can be defrosted in a simple manner in that cyclic process is reversed without a need for a withdrawal from a heating plant which is operatively connected to the condenser and without a need for a consumption of superheat energy. The defrosting energy is supplied from the condensate so that the defrosting is highly economical, as is desired. Besides, the pressure and temperature remain relatively low during the defrosting operation so that a low structural expenditure is sufficient for the plant. Moreover, the heat accumulator need not be supplied with condensate having a temperature in excess of a certain lower limit and a special adaptation of the condenser is not required so that the heat pump can be combined with heating system of any kind without any restriction.

To permit the process in accordance with the invention to be carried out in a simple manner in a heat pump comprising a circulating line which incorporates a compressor, condenser, throttle valve and evaporator and which extends through a heat accumulator and is provided with a by-pass line which by-passes the condenser, the circulating line and the inlet and outlet of the compressor are interconnected by a four-way valve, the heat accumulator is connected between the condenser and the throttle valve, a by-pass line by-passing the condenser branches from the circulating line between the condenser and the heat accumulator, the by-pass line incorporates a unidirectional check valve which permits only a flow from the heat accumulator, and that section of the circulating line which leads from the by-pass line to the condenser incorporates a check valve which pemits only a unidirectional flow only from the condenser to the heat accumulator. The heat accumulator, by-pass line and check valves do not involve a high structural expenditure and can readily be integrated in a compact heat pump plant. The nature of the heat accumulator used to extract heat from the condensate is not significant and said accumulator may store heat in a liquid or in a solid. But the heat capacity of the heat accumulator should suitably be so high that under the least favorable conditions, i.e., when the lowest condensate temperature and the strongest icing tendency occur at the same time, the accumulated heat will be sufficient for an evaporation of the reversely flowing refrigerant at a rate which is suitable in view of the performance of the compressor.

The efficiency can be improved in that a vapor barrier, such as a float valve, may be incorporated in the circulating line between the condenser and the associated check valve. Such vapor barrier will reliably prevent a flow of residual refrigerant vapor from the condenser into the heat accumulator so that the latter will extract heat only by a supercooling of the condensate rather than as heat of condensation of vapor because this would adversely affect the economy.

BRIEF DESCRIPTION OF THE DRAWING

The drawing is a diagrammatic view illustrating a plant which embodies the invention.

DETAILED DESCRIPTION OF THE PREFERRED EMBODIMENT

A heat pump plant which uses air as a heat source comprises a compressor 1, a condenser 2, a throttle valve 3 and an air-contacted evaporator 4. A circulating line 5 is provided for circulating the refrigerant in a closed cycle. In the evaporator 4, the refrigerant is evaporated as it absorbs heat of evaporation from the air. That heat of evaporation is raised to a higher temperature by the compressor 1 and in the condenser 2 is transferred as heat of condensation from the condensing refrigerant to a heating circuit 6, which is in heat exchange relation to the condenser 2. The condensed refrigerant then flows in the circulating line 5 to the throttle valve 3, where the refrigerant is depressurized, and is then recycled to the evaporator 4.

When the evaporator 4 has become iced, it is to be defrosted in an economical manner and without a need for extranesous energy. This is effected in that the circulation in the heat pump is reversed. For this purpose the circulating line 5 incorporates a four-way valve 7, which in one position connects the inlet **5*a* of the compressor 1 to that section of the circulating line 5 which leads to the condenser 2 and whereas it connects the outlet 5*b* of the compressor to that section of the circulating line 5 which leads to the evaporator 4, and in a second position reverses said connections. From the condenser 2 the circulating line 5 extends through a heat accumulator 8. The condenser 2 is by-passed by a by-pass line 9, which branches from the circulating line 5 between the heat accumulator 8 and the condenser 2. The direction of flow in the by-pass line 9 and in that section 5*c* of the circulating line 5 which is by-passed by the by-pass line 9 is controlled by respective check valves 10, 11, which permit in the by-pass line 9 a flow only in the direction from the heat accumulator 8 and in the section 5*c* permit a flow only toward the heat accumulator 8. For a reversal of the circulation, the throttle valve 3 and a check valve 12 preceding the throttle valve are by-passed by a return line 13, which incorporates a throttle valve 15 and a check valve 14** permitting a reverse flow.

During normal heating operation the four-way valve 7 connects the inlet **5*a* of the compressor 1 to that section of the circulating line 5 which comes from the evaporator 4 and connects the outlet 5*b* of the compressor 1 to that section of the circulating line which leads to the condenser 2. As a result the refrigerant vapor flows from the evaporator 4 through the compressor 1 into the condenser 2 and can be used to heat the heating circuit 6. In that mode of operation the check valve 10 prevents an escape of the refrigerant through the by-pass line 9. The condensed refrigerant leaves the condenser 2 and flows through the heat accumulator 8, which extracts and accumulates surplus heat from the condensate so that the latter is supercooled. The supercooled condensate is conducted through the check valve 12 to the throttle valve 3, where it is depressurized, and is subsequently returned to the evaporator. In order to ensure that the heat accumulator 8 is not supplied with heat of condensation of residual refrigerant vapor but only with surplus heat of the condensate, the section 5*c* of the circulating line 5 extending between the condenser 2 and the check valve 11 incorporates a float valve 16 comprising a float 16*a*, which permits a flow through the valve 16** only when it is supplied with condensate.

When it is desired to defrost the evaporator 4, the four-way valve 7 is moved to its second position so that refrigerant vapor is now forced by the compressor 1 through its outlet **5*b* into the evaporator 4, where said vapor condenses and the heat of condensation which is thus released causes the evaporator 4 to be defrosted. Thereafter the condensed refrigerant flows through the return line 13 and the check valve 14 to the throttle valve 15, in which the refrigerant is depressurized, and then back to the circulating line 5, which extends through the heat accumulator 8. The heat accumulated in the heat accumulator 8 now causes the refrigerant to be evaporated and the check valves 11 and 10 ensure that the resulting vapor will be conducted in the by-pass line 9 past the condenser 2. From the by-pass line 9 the vapor returns through the four-way valve 7 to the inlet 5*a* of the compressor. It is apparent that the evaporator 4 is defrosted in an economical manner by means of surplus heat extracted from the condensate in the heat accumulator 8 and without any risk of a cooling of the heating circuit 6**.

I claim:

1. A system of defrosting an evaporator in a heat pump and refrigerating installation which comprises a closed circulating circuit for a refrigerant, the circuit including the evaporator, a compressor, a condenser, a heat accumulator, and throttle valve means for depressurizing the refrigerant between the evaporator and the heat accumulator, the circulating circuit being arranged for sequentially conducting the refrigerant, during a normal heating operation, from the compressor through the condenser, the heat accumulator, the throttle valve means and the evaporator back to the compressor, the refrigerant being condensed in the condenser, the heat accumulator extracting and accumulating heat from the condensed refrigerant to supercool the refrigerant and the supercooled, depressurized refrigerant flowing to the evaporator, and the circulating circuit being arranged for reversing the flow of the refrigerant to conduct the refrigerant sequentially, during a defrosting operation, from the compressor through the evaporator, the throttle valve means, the heat accumulator and, by-passing the condenser, back to the compressor, the refrigerant being condensed in the evaporator to generate heat of condensation causing the evaporator to be defrosted and the accumulated heat in the heat accumulator causing the condensed, depressurized refrigerant to be evaporated in the heat accumulator before it is conducted back to the compressor without passing through the condenser.

2. The system of claim 1, wherein the throttle means comprises a first and a second throttle valve respectively arranged in the circulating circuit for depressurizing the refrigerant as it flows from the heat accumulator to the evaporator and from the evaporator to the heat accumulator, and further comprising a by-pass line for by-passing the condenser.

3. The system of claim 2, wherein the circulating circuit comprises a compressor inlet and a compressor outlet, a four-way valve connecting the compressor inlet and outlet to lines respectively leading to the evaporator and the condenser, the heat accumulator being arranged between the condenser and the first throttle valve, the by-pass line leading from the heat accumulator to the line leading from the compressor outlet to the condenser, a first check valve in the by-pass line for unidirectionally conducting the evaporated refrigerant from the heat accumulator, a further line leading from the by-pass line to the condenser, and a second check valve in the further line for unidirectionally conducting the condensed refrigerant from the condenser to the heat accumulator.

4. The system of claim 3, further comprising a vapor barrier arranged in the further line between the condenser and the second check valve.

5. The system of claim 4, wherein the vapor barrier is a float valve.

* * * * *